US007137532B2

(12) United States Patent
Jeter

(10) Patent No.: US 7,137,532 B2
(45) Date of Patent: Nov. 21, 2006

(54) STRAINER AND LEVEL INDICATOR FOR A HOT MELT ADHESIVE SYSTEM

(75) Inventor: David R. Jeter, Woodstock, GA (US)

(73) Assignee: Nordson Corporation, Westlake, OH (US)

( * ) Notice: Subject to any disclaimer, the term of this patent is extended or adjusted under 35 U.S.C. 154(b) by 336 days.

(21) Appl. No.: 10/266,194

(22) Filed: Oct. 8, 2002

(65) Prior Publication Data

US 2003/0080154 A1 May 1, 2003

Related U.S. Application Data

(60) Provisional application No. 60/346,145, filed on Oct. 29, 2001.

(51) Int. Cl.
*B67D 5/62* (2006.01)

(52) U.S. Cl. ..... 222/146.5; 222/146.1; 222/146.2; 222/189.06; 222/64

(58) Field of Classification Search ..... 222/146.5, 222/146.1, 146.2, 189.06, 189.11, 64; 118/202, 118/203; 210/86
See application file for complete search history.

(56) References Cited

U.S. PATENT DOCUMENTS 2,524,313 A * 10/1950 Gerling ..... 210/453
3,325,156 A 6/1967 Cooper, III ..... 263/11
3,426,945 A 2/1969 Harriman ..... 222/135
3,815,788 A * 6/1974 Reighard et al. ..... 222/146.5
3,898,955 A 8/1975 Rosette et al. ..... 118/603
3,912,630 A * 10/1975 Reighard et al. ..... 210/130
4,169,055 A 9/1979 Lydford ..... 210/104
4,395,968 A 8/1983 Wahnschaff et al. ..... 118/602
4,485,941 A * 12/1984 Frates et al. ..... 222/146.5
4,485,942 A * 12/1984 Petrecca ..... 222/146.5
4,999,124 A * 3/1991 Copeland ..... 510/514
5,061,170 A * 10/1991 Allen et al. ..... 425/197
5,456,828 A * 10/1995 Tersi et al. ..... 210/184
5,523,537 A * 6/1996 Johannes et al. ..... 219/421
5,735,588 A 4/1998 Dittman et al. ..... 312/330
6,155,806 A 12/2000 Andel ..... 417/523

FOREIGN PATENT DOCUMENTS

DE 2346825 3/1975
WO 0023167 4/2000
WO WO03/037526 A1 * 5/2004

* cited by examiner

*Primary Examiner*—Frederick C. Nicolas
(74) *Attorney, Agent, or Firm*—Wood, Herron & Evans, L.L.P.

(57) ABSTRACT

A strainer for a hot melt adhesive system is fixed to the side wall(s) of a tank without fasteners to strain the adhesive flow and protect a pump of the system. The strainer may also be configured to act as a shield for a level indicator located within the tank.

9 Claims, 3 Drawing Sheets

STRAINER AND LEVEL INDICATOR FOR A HOT MELT ADHESIVE SYSTEM

CROSS-REFERENCE TO RELATED APPLICATIONS

This application claims the benefit of U.S. Provisional Application No. 60/346,145 filed on Oct. 29, 2001, and the disclosure of which is hereby incorporated by reference herein.

FIELD OF THE INVENTION

The present invention pertains to dispensing systems for dispensing flowable material, and more particularly to hot melt adhesive dispensing systems.

BACKGROUND OF THE INVENTION

Thermoplastic adhesives, otherwise known as "hot melt" adhesives have been widely used in industry for adhering many types of products. Hot melt adhesive dispensing systems generally include a dispenser coupled with one or more dispensing guns, heated hoses connected to the guns, and a dispensing unit for melting and supplying heated liquid adhesive to the guns through the heated hoses. The dispensing unit of conventional hot melt adhesive systems include a tank, a heater, a pump, a manifold, and a controller. The heater is generally located in a base of the tank for melting and heating solid or semi-solid adhesive material received in the tank.

After the adhesive material is melted and heated in the tank, a pump coupled to the tank and the manifold pumps liquid adhesive from the tank, through the manifold and heated hoses to the dispensing guns. The controller controls the power supplied to the tank heater and heated hoses to maintain the liquid adhesive at an appropriate viscosity and temperature depending on the application. The controller also performs many other control operations of the system.

Conventional dispensing units further include a strainer which is loosely placed in the bottom of the tank to cover the tank outlet. The strainer prevents foreign objects in the adhesive flow from entering the pump and can be freely removed from the tank to permit cleaning of the tank. A drawback of this design is that operators occasionally neglect to replace the strainer after cleaning and prior to resuming operation of the hot melt system. This exposes the pump to potentially severe damage from foreign objects that may fall into the tank and get drawn into the pump. For at least this reason, a need exists for a more robust strainer design which prevents foreign objects from entering the pump and permits access to the tank for cleaning, yet which is failsafe to prevent operation without the strainer.

In some hot melt adhesive systems, the dispensing unit further includes an adhesive level indicator located in the tank interior. A shield is generally provided to protect the level indicator from damage by foreign objects or from being impacted by solid or semi-solid adhesive as it is deposited into the tank. An improved strainer that could also function as a shield for a level indicator would be an even more desired improvement over previous dispensing unit designs.

SUMMARY OF THE INVENTION

The present invention therefore provides an improved strainer for a dispensing unit of a hot melt adhesive system.

The strainer is fixed to the tank interior to prevent removal from the tank, thereby eliminating or at least significantly reducing the possibility of operation without the strainer in place. In operation, the strainer strains liquid adhesive flowing from the tank to the pump to protect the pump from damage by foreign objects that may be in the adhesive flow.

The strainer is fixed to the side wall of the tank so that the tank bottom is readily accessible for cleaning. In one aspect of the invention, the strainer is fixed to the side wall(s) without the use of fasteners which may work loose and enter the pump where they could cause damage. In another aspect of the invention, the strainer is fixed to the wall(s) of a tank to surround an adhesive level indicator installed in the tank interior. In this embodiment, the strainer also acts as a shield for the level indicator while also straining the adhesive flow to protect the pump.

In yet another aspect of the invention the strainer is fixed to the side wall(s) of a tank and is further retained within the tank by a top wall of the tank to ensure that the strainer cannot be removed and inadvertently misplaced or otherwise not replaced in the tank prior to subsequent operation of the dispensing unit.

These and other features, advantages and objectives of the invention will become more readily apparent to those of ordinary skill in the art upon review of the following detailed description of the preferred embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain details of the preferred embodiments.

DETAILED DESCRIPTION

Figure 1:
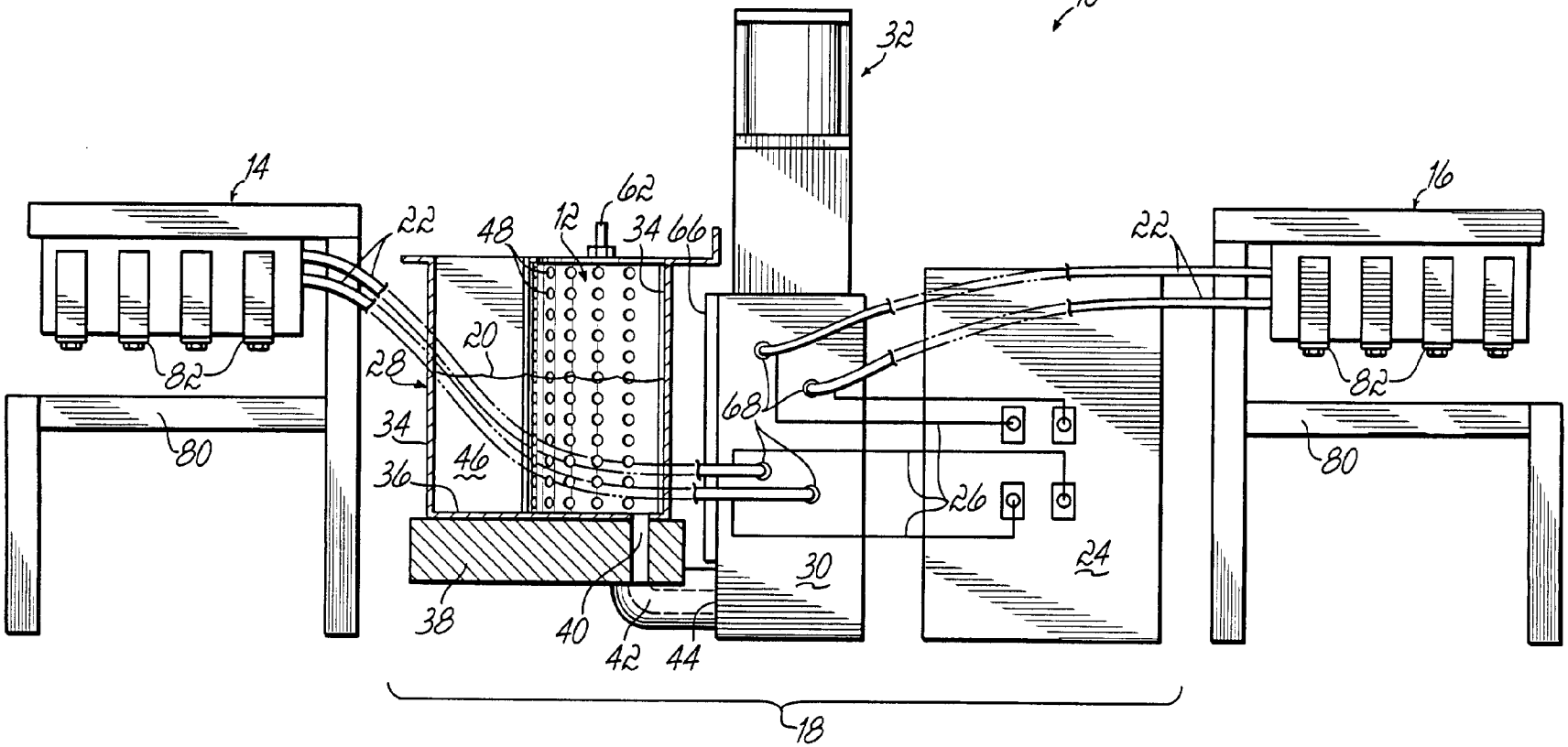
FIG. 1 is a schematic illustration of a hot melt adhesive system, including a dispensing unit that has a strainer incorporating the principles of the present invention.

Referring to FIG. 1, there is shown a hot melt adhesive system 10 incorporating a strainer 12 constructed according to the present invention. The hot melt adhesive system 10 may include a number of adhesive guns 14, 16, a dispensing unit 18 for supplying hot melt adhesive 20 to the guns 14, 16, and heated hoses 22. The heated hoses 22 are electrically coupled to a controller 24 by cord sets 26. Hoses 22 fluidly connect the dispensing unit 18 to the guns 14, 16. The dispensing unit 18 includes tank 28 for receiving and melting hot melt adhesive 20, a manifold 30 in fluid communication with the tank 28, a pump 32 coupled to the manifold 30, and controller 24.

Figure 2:
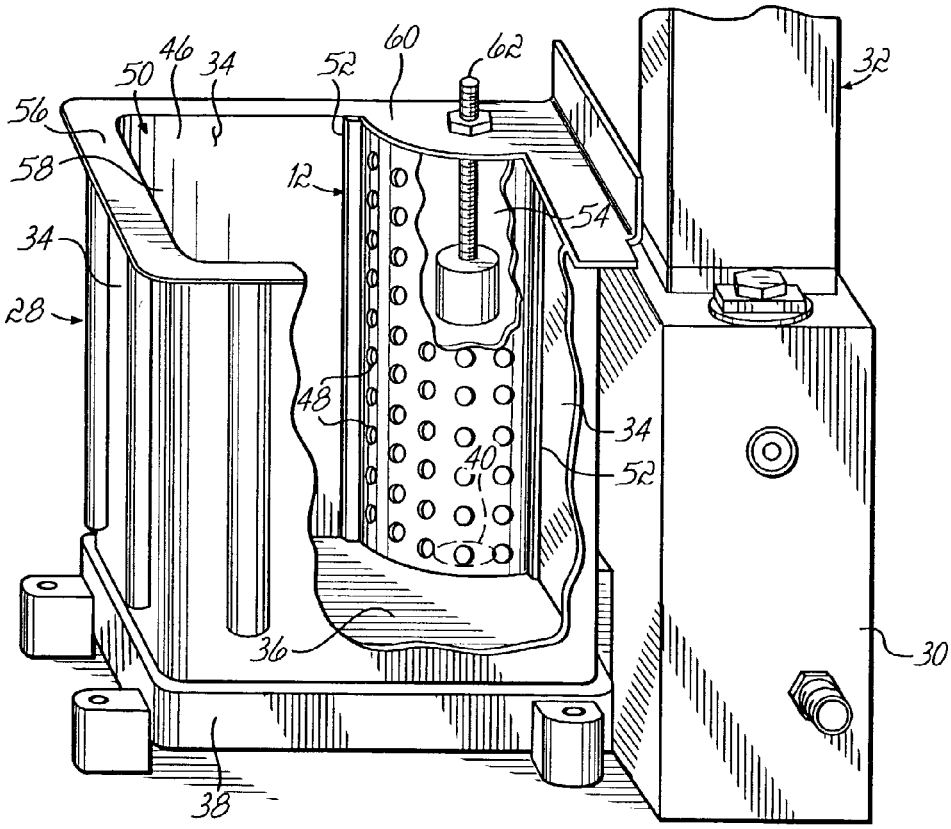
FIG. 2 is a perspective view of a tank for a dispensing unit of a hot melt adhesive system wherein a portion of the tank wall has been removed so that the interior of the tank, having a strainer incorporating principles of the present invention, can be seen.
Figure 3:
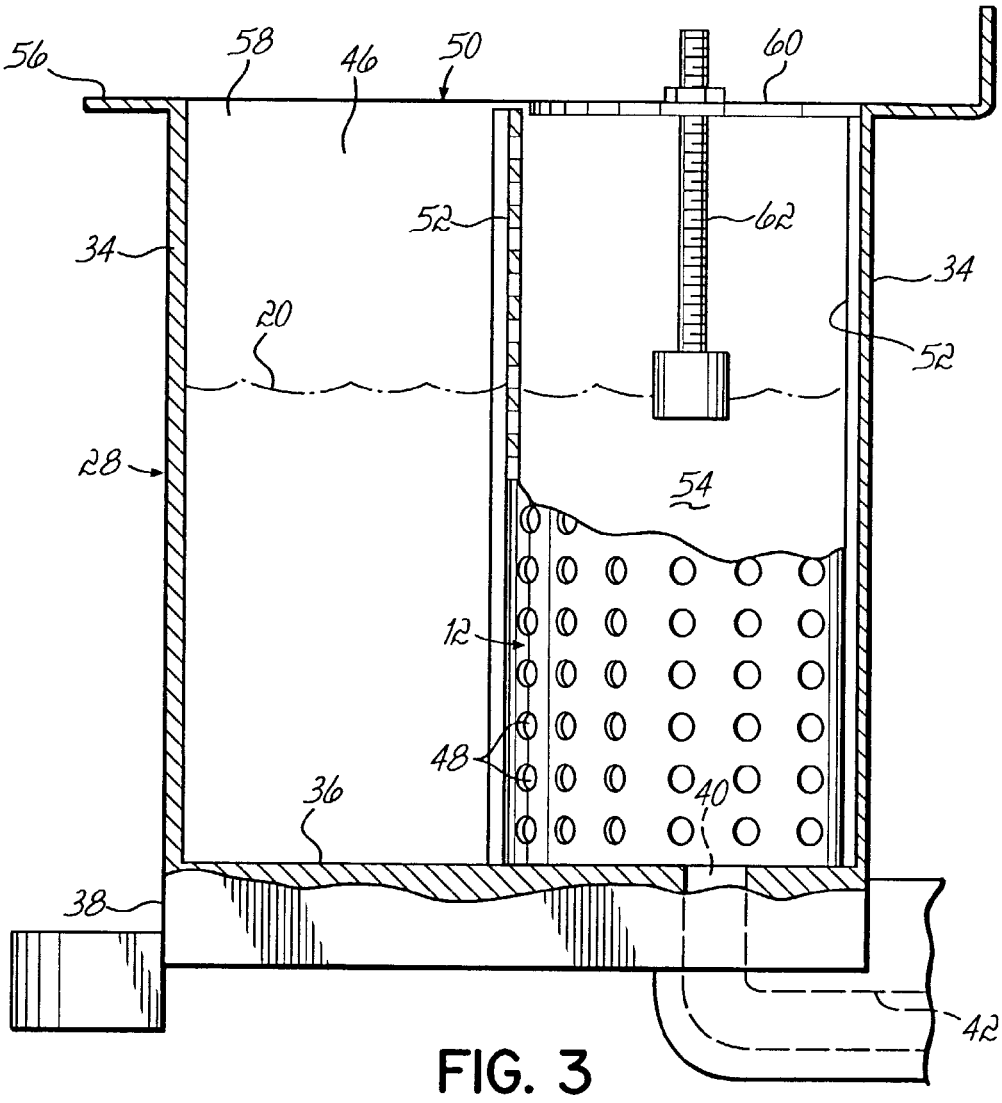
FIG. 3 is a schematic cross-sectional view of the tank.

Referring further to FIGS. 2 and 3, the tank 28 comprises side walls 34 and base 36 which includes a tank heater 38 for melting and heating the adhesive material 20 in the tank 28. Generally, tank heater 38 is cast into the tank base 36. A tank outlet 40 proximate the base 36 is coupled to a passage 42 which connects to an inlet 44 of the manifold 30. A strainer 12 constructed according to the present invention is fixed to side walls 34 in the tank interior 46.

The strainer 12 is constructed from a sheet of semi-rigid material, such as metal or plastic, and has a plurality of apertures 48 formed in its surface. The strainer 12 is fixed to adjacent side walls 34 of the tank 28 proximate the outlet 40 and extends from the tank base 36 towards an open end 50 of the tank 28 opposite the base 36. In the exemplary embodiment shown in FIGS. 2 and 3, the side walls 34 of the tank 28 have bosses 52 extending out from the side walls 34 and the strainer 12 is fixed to the side walls 34 by sliding the strainer 12 between the bosses 52.

The strainer 12 and side walls 34 define a strained volume 54 of the tank 28 which includes the outlet 40. When the tank 28 is filled with liquid material, such as hot melt adhesive, the liquid material may flow through the strainer 12 toward the outlet 40 of the tank 28. The apertures 48 formed into the strainer 12 are sized to prevent undesirable foreign objects from passing into the strained volume 54 and through the tank outlet 40. The tank 28 may further include a top wall 56, opposite the tank base 36, and having an opening 58 for admitting new adhesive material into the tank 28. The top wall 56 includes a rim 60 that borders at least one side wall 34 of the tank 28 to secure the strainer 12 within the tank 28. The strainer 12 is thus fixed within the tank 28 without the need for fasteners which could come loose and work their way into the outlet 40, which is ultimately connected to pump 32 which could be damaged by the fasteners.

Figure 4:
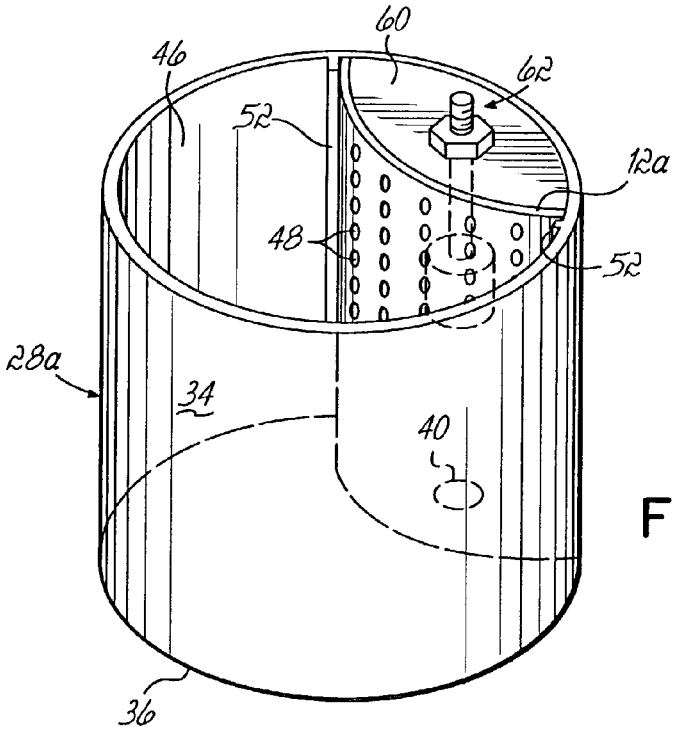
FIG. 4 is a schematic perspective view of another embodiment of a strainer according to the principles of the present invention.

In some instances it is desirable to determine the level of fluid inside the tank 28 with a level indicator 62. In such applications, the level indicator 62 may be positioned within the strained volume 54 defined by the strainer 12 and side walls 34, as depicted in FIGS. 2 and 3. The strainer 12 may thus be used as a shield to protect the level indicator 62 from being impacted by foreign objects in the liquid adhesive or by solid adhesive material that is being added to the tank 28. FIG. 4 shows an alternate embodiment the strainer 12*a* of the present invention wherein the strainer 12*a* is positioned within a tank 28*a* of substantially circular cross section.

Referring to FIG. 1, manifold 30 is located adjacent the tank 28 and includes a manifold heater 66 that is separate from the tank heater 38 and which can be independently controlled by the controller 24. Pump 32 is coupled to the manifold 30 and pumps liquid adhesive 20 from the strained volume 48, through the tank outlet 40, and into the manifold 30. The apertures 48 in the strainer 12 are sized to capture foreign objects in the adhesive flow which would otherwise enter and damage the pump 32.

The manifold 30 splits the adhesive 20 into separate flows and directs the flows to a plurality of outlet ports 68. The plurality of outlet ports 68 are configured to be coupled to the heated hoses 22 whereby the liquid adhesive 20 is supplied to the dispensers 14, 16.

The guns 14, 16 may be mounted to a frame 80 and include one or more adhesive dispensing modules 82 which apply the adhesive 20 to a desired product (not shown). The hot melt adhesive system 10 illustrated in FIG. 1 includes two adhesive guns 14, 16, however a given hot melt system may have a single gun, or it may have more than two guns, according to the particular adhesive dispensing requirements.

While the present invention has been illustrated by the description of various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of applicant's general inventive concept.

What is claimed is:

1. A hot melt dispenser comprising:

a tank with at least one side wall and a base collectively defining a tank interior having an opening at an upper end thereof for receiving hot melt adhesive, and an outlet proximate said side wall and communicating with said tank interior proximate a lower end of said tank interior;

a strainer fixed in said tank interior adjacent said side wall proximate said outlet and extending in an upright manner from a position proximate said upper end to said lower end to define a strained volume including said outlet, said strainer having a plurality of apertures sized to permit liquid hot melt adhesive to pass through said strainer but to block debris as the liquid hot melt adhesive flows through said strainer toward said outlet; and an adhesive level indicator in said tank interior and positioned within said strained volume.

2. The dispenser of claim 1 wherein said strainer is affixed to said side wall without the use of fasteners separable from said strainer or said side wall.

3. The dispenser of claim 1 wherein said side wall is formed from an extrusion and further comprising integral bosses configured to secure said strainer to said side wall.

4. The dispenser of claim 1 wherein said strainer extends from said tank base toward said opening of said tank and said tank further includes a top wall opposite said tank base, said top wall having an opening for receiving adhesive material into said tank and having a rim bordering said side wall to further secure said strainer within said tank interior.

5. The dispenser of claim 1 wherein said tank includes multiple side walls and said strainer extends across portions of two of said side walls.

6. The dispenser of claim 1 wherein said tank includes a generally cylindrically-shaped side wall and said strainer extends across a portion of said cylindrically-shaped side wall.

7. The dispenser of claim 4 wherein said top wall projects from said side wall to enclose the volume.

8. A hot melt adhesive dispenser comprising:

a tank having at least one side wall and a base collectively defining a tank interior having an opening at an upper end thereof for receiving hot melt adhesive, said base including a tank outlet proximate said side wall and communicating with said tank interior proximate a lower end thereof;

a strainer disposed in said tank interior adjacent said side wall proximate said tank outlet and extending in an upright manner from a position proximate said upper end to said lower end to define a strained volume including said tank outlet, said strainer having a plurality of apertures sized to permit liquid hot melt adhesive to pass through said strained volume but to block debris as the liquid hot melt adhesive flows through said strainer toward said tank outlet; and wherein said side wall is formed from an extrusion and further comprising integral bosses configured to secure said strainer to said side wall.

9. A dispenser for dispensing hot melt adhesive, comprising:

a dispensing unit including a tank having at least one side wall and a base collectively defining a tank interior having an opening at an upper end thereof, said base including a tank outlet proximate said side wall and proximate a lower end of said tank interior, and a heater for heating and melting the hot melt adhesive material;

a strainer fixed in said tank interior to said side wall proximate said tank outlet and extending in an upright manner from a position proximate said upper end to said lower end to define a strained volume including said tank outlet, said strainer having a plurality of apertures sized to permit liquid hot melt adhesive to pass through said strained volume but to block debris as the liquid hot melt adhesive flows through said strainer toward said tank outlet;

an adhesive level indicator in said tank interior and positioned within said strained volume;

a manifold having an inlet and at least one outlet, said inlet coupled in fluid communication with said tank outlet; and a pump coupled in fluid communication with said manifold for pumping the liquid hot melt adhesive from said tank outlet, through said manifold inlet to said manifold outlet.

* * * * *

UNITED STATES PATENT AND TRADEMARK OFFICE

CERTIFICATE OF CORRECTION

PATENT NO. : 7,137,532 B2
APPLICATION NO. : 10/266194
DATED : November 21, 2006
INVENTOR(S) : David R. Jeter It is certified that error appears in the above-identified patent and that said Letters Patent is hereby corrected as shown below:

Column 4

Line 49, "enclose the volume." should read --enclose the strained volume.--

Signed and Sealed this

Thirteenth Day of March, 2007

JON W. DUDAS
*Director of the United States Patent and Trademark Office*